US011375796B2

(12) United States Patent
Lee

(10) Patent No.: US 11,375,796 B2
(45) Date of Patent: Jul. 5, 2022

(54) STICK-TYPE COSMETIC MATERIAL CONTAINER HAVING SIDE BUTTON

(71) Applicant: PUM-TECH KOREA CO., LTD, Incheon (KR)

(72) Inventor: Do Hoon Lee, Incheon (KR)

(73) Assignee: PUM-TECH KOREA CO., LTD, Incheon (KR)

( * ) Notice: Subject to any disclaimer, the term of this patent is extended or adjusted under 35 U.S.C. 154(b) by 375 days.

(21) Appl. No.: 16/621,399

(22) PCT Filed: Jun. 20, 2018

(86) PCT No.: PCT/KR2018/006949
§ 371 (c)(1),
(2) Date: Dec. 11, 2019

(87) PCT Pub. No.: WO2019/009537
PCT Pub. Date: Jan. 10, 2019

(65) Prior Publication Data

US 2020/0163439 A1 May 28, 2020

(30) Foreign Application Priority Data

Jul. 3, 2017 (KR) ..... 10-2017-0084112

(51) Int. Cl.
*A45D 40/02* (2006.01)
*A45D 40/04* (2006.01)
(Continued)

(52) U.S. Cl.
CPC ..... *A45D 40/023* (2013.01); *A45D 40/04* (2013.01); *A45D 40/065* (2013.01); *A45D 2040/0025* (2013.01)

(58) Field of Classification Search
CPC ..... A45D 40/00; A45D 40/04; A45D 40/023; A45D 40/06; A45D 40/065; A45D 40/10;
(Continued)

(56) References Cited

U.S. PATENT DOCUMENTS 7,429,140 B2 * 9/2008 Demellier ..... A45D 40/10 401/262
7,841,794 B2 * 11/2010 Salciarini ..... A45D 40/10 401/262
2013/0343800 A1 12/2013 Drugeon et al.

FOREIGN PATENT DOCUMENTS

KR 10-0913110 B1 8/2009
KR 20-0459451 Y1 3/2012
(Continued)

*Primary Examiner* — David J Walczak
(74) *Attorney, Agent, or Firm* — Heedong Chae; Lucem, PC

(57) ABSTRACT

A container having: a container body having a stick-type cosmetic material embedded therein; a container cap for opening/closing the container body; a side button provided on a side surface of the container cap; a moving member elastically moving up and down by means of an elastic member on the inside of the container cap, and having a fastening part formed therein; a fixing member for restricting the separation of the moving member from the container cap; and an operating member fastened to or unfastened from the fastening part of the moving member by elastically moving back and forth by means of the button, thereby having a structure in which the fastening of the operating member and the moving member is released so as make the container body, which is inserted into the moving member while the moving member is elastically moved to the lower side.

6 Claims, 9 Drawing Sheets

(51) Int. Cl.
*A45D 40/00* (2006.01)
*A45D 40/06* (2006.01)

(58) Field of Classification Search
CPC ..... A45D 40/20; A45D 2040/0025; A45D 2040/10; B65D 83/0005; B65D 83/0011; B65D 83/0022; B65D 83/0027
USPC ..... 401/171, 172, 174, 75, 78, 68, 98
See application file for complete search history.

(56) References Cited

FOREIGN PATENT DOCUMENTS

| | | | |
|---|---|---|---|
| KR | 10-2017-0067561 | A | 6/2017 |
| KR | 10-2017-0067564 | A | 6/2017 |

* cited by examiner

-PRIOR ART-

-PRIOR ART-

STICK-TYPE COSMETIC MATERIAL CONTAINER HAVING SIDE BUTTON

TECHNICAL FIELD

The present invention relates to a stick-type cosmetic material container having a side button, and more particularly, to a stick-type cosmetic material container having a side button, in which the stick-type cosmetic material container includes a container body provided therein with a stick-type cosmetic material, and a container cap for opening and closing the container body, the stick-type cosmetic material container including: a side button provided on a side surface of the container cap; a moving member provided inside the container cap to elastically move up and down by an elastic member, and having a fastening part; a fixing member for restricting the moving member from being separated from the container cap; and an operating member fastened to or unfastened from the fastening part of the moving member by moving back and forth by the button, wherein when the operating button is moved to a central portion of the container cap as the side button is pressed, a fastening state between the operating member and the moving member is released, so that the moving member is elastically moved downward while the container body inserted into the moving member falls down out of the container cap so as to be pulled out, thereby improving productivity by a simple structure in which the container body falls out from the container cap, and facilitating use.

BACKGROUND ART

In general, women use various cosmetic products to make their appearance more beautiful. Among the cosmetic products, color cosmetics are used to beautifully adorn the skin of a user by making the appearance beautiful.

Such color cosmetics are classified into a base makeup used for making the skin color uniform and covering defects, and a point makeup for partially enhancing the three-dimensional effect on lips, eyes, nails, and the like. The base makeup includes a makeup base, a foundation, and a powder, and the point makeup includes a lipstick, an eye liner, and a mascara.

Among various cosmetic products necessary for the color makeup of women, the lipstick is used to perform the makeup to protect lips and make the lips more beautiful. A conventional lipstick is manufactured in the form of a stick formed of a cosmetic composition having various colors so as to be withdrawn from or inserted into a lipstick cosmetic container while ascending and descending inside the lipstick cosmetic container.

In other words, the conventional lipstick cosmetic container as described above generally includes: a case for maintaining an exterior of the cosmetic container; a lipstick holder screwed inside the case to ascend and descend along a screw thread by a rotating operation of the case, and mounted thereon with a stick-type cosmetic product; a protective tube provided between the case and the lipstick holder while being partially exposed to an outside to protect the cosmetic product while guiding a vertical movement of the lipstick holder; a fastening cap fastened to an upper portion of the case to securely fix the protective tube; and an over-cap for opening and closing the case.

However, when the over-cap of the conventional lipstick cosmetic container is weakly fastened with the case, the over-cap may be easily separated from the case and lost while being carried, and when the over-cap is strongly fastened with the case, it is inconvenient to use because women who are relatively weak in strength may not easily separate the over-cap from the case.

To solve the above problems, as shown in FIG. 1, Korean Utility Model Registration No. 20-0459451 discloses a lipstick container, in which the conventional lipstick container includes: a container body portion; a lipstick holder coupled to the container body portion; and a container cap having a cap bottom portion and a cap side portion having a circular tube shape extending from the cap bottom portion, and coupled to the container body portion to surround a lipstick which is coupled to the lipstick holder, wherein the container cap is prevented from being separated from the container body portion by a one-touch structure.

In other words, referring to the one-touch structure of the conventional lipstick container in more detail, the one-touch structure includes: a linear motion operating tube having a circular tube shape and provided inside the container cap to move toward the cap bottom portion when the container body portion is pressed toward the cap bottom portion; a spring provided inside the container cap to accumulate a return elastic force for returning the linear motion operating tube to an original position thereof when the linear motion operating tube moves toward the cap bottom portion; and a return selection unit configured to alternately perform, in conjunction with an operation of pressing the container body portion toward the cap bottom portion, a return stopping operation for preventing the return elastic force accumulated in the spring from being transmitted to the linear motion operating tube to prevent the linear motion operating tube from returning to the original position thereof, and a return stopping release operation for canceling the return stopping operation by allowing the return elastic force accumulated in the spring to be transmitted to the linear motion operating tube.

However, in the above related art, the linear motion tube, the spring, and the return selection unit are provided in the container cap in order to allow the lipstick container to fall out to an outside or to be inserted into the container body, and the return selection unit includes an upward motion guide inclined surface, a guide groove, a latching sill, an upward auxiliary guide inclined surface, a shaft connecting portion, a rotary motion operating body, and the like, so that the above related art has a complicated structure, resulting in a decrease in productivity.

In order to solve such problems, as shown in FIG. 2, Korean Unexamined Patent Publication No. 10-2017-0067561 discloses a lipstick container assembly.

In the conventional lipstick container assembly, a main lid is provided on an inner upper portion of an auxiliary lid to selectively ascend and descend within a predetermined section, and an operation button and an elastic deformation operating member to lower the main lid on the upper portion of the auxiliary lid by an elastic force are provided, so that the conventional lipstick container assembly has a simple structure, and a lower end of a lipstick receiving member coupled to the main lid falls out downward through a simple pressurization operation of the operation button, so that the lipstick receiving member may be selectively separated from the main lid for use.

However, in the above related art, since a latching hook of the main lid and a latching protrusion of the elastic deformation operating member are provided on only one surface, the latching hook and the latching protrusion have to face each other when assembling the main lid with the elastic deformation operating member, so that there has been an inconvenience in that the assembly has to be performed such that a lifting guide protrusion provided on the auxiliary lid is fitted to a lifting guide groove formed in the main lid.

In addition, since the above related art has a structure in which a fastening state between the elastic deformation operating member and the main lid is released as a shape of the elastic deformation ring of the elastic deformation operating member is deformed by pressing the operation button, the elastic deformation operating member may be damaged or the elastic deformation operating member may be deformed when used for a long time, so that operations of the elastic deformation operating member and the main lid may not be performed smoothly.

DISCLOSURE

Technical Problem

To solve the problems described above, an object of the present invention is to provide a stick-type cosmetic material container having a side button, in which the stick-type cosmetic material container includes a container body provided therein with a stick-type cosmetic material, and a container cap for opening and closing the container body, the stick-type cosmetic material container including: a side button provided on a side surface of the container cap; a moving member provided inside the container cap to elastically move up and down by an elastic member, and having a fastening part; a fixing member for restricting the moving member from being separated from the container cap; and an operating member fastened to or unfastened from the fastening part of the moving member by moving back and forth by the button, wherein when the operating button is moved to a central portion of the container cap as the side button is pressed, a fastening state between the operating member and the moving member is released, so that the moving member is elastically moved downward while the container body inserted into the moving member falls down out of the container cap so as to be pulled out, thereby improving productivity by a simple structure in which the container body falls out from the container cap, and facilitating use.

In addition, an object of the present invention is to provide a stick-type cosmetic material container having a side button, in which a fastening part having a cylindrical shape protrudes from an upper portion of a moving member which is provided inside a container cap so as to be movable up and down, and a fastening part through-hole through which the fastening part passes is formed at a center of an operating member, wherein a first fastening protrusion wheel is provided at an outer periphery of the fastening part, and a second fastening protrusion wheel is provided in the fastening part through-hole so that the first and second fastening protrusion wheels may be coupled to each other. Accordingly, the moving member and the operating member may be assembled with each other regardless of a coupling direction of the first and second fastening protrusion wheels upon assembly of the stick-type cosmetic material container, so that an assembly process is simplified, which increases productivity.

In addition, an object of the present invention is to provide a stick-type cosmetic material container having a side button, in which the moving member is coupled to a fixing member fixedly provided inside the container cap so as to be movable back and forth, and an elastic support part is provided in the fixing member to allow the operating member to be elastically and horizontally moved by the elastic support part, so that the operating member may be operated smoothly without being deformed or damaged even when the operating member is used for a long time.

Technical Solution

According to the present invention, there is provided a stick-type cosmetic material container having a side button, in which the stick-type cosmetic material container includes a container body provided therein with a stick-type cosmetic material to withdraw or introduce the stick-type cosmetic material, and a container cap for opening and closing the container body, the stick-type cosmetic material container including:

a side button provided on a side surface of the container cap;

a moving member movably provided inside the container cap, in which an upper portion of the container body is inserted into the moving member, and having a fastening part having a cylindrical shape;

an operating member moved by the side button and having a fastening part through-hole through which the fastening part passes;

a fixing member fixedly provided inside the container cap; and an elastic member for elastically supporting the moving member, wherein the fixing member is provided with an elastic support part to elastically support the operating member, and the fastening part of the moving member is provided with a first fastening protrusion wheel having a ring shape, and the fastening part through-hole of the operating member is provided with a second fastening protrusion wheel coupled with the first fastening protrusion wheel, so that a fastening state between the operating member and the moving member is released as the fastening part through-hole of the operating button is moved horizontally to a central portion of the container cap when the side button is pressed.

In addition, the container cap may be coupled to the container body to surround an entirety of the container body.

In addition, the elastic support part of the fixing member may include a first elastic piece bent in a curved shape from an upper end of the fixing member to extend downward, and a second elastic piece bent in a curved shape from the first elastic piece to extend upward, and an elastic space may be formed between the first elastic piece and the second elastic piece.

In addition, the fixing member may be provided with a movement restriction protrusion to restrict the moving member from being separated from the container cap.

In addition, an elastic slit may be formed between separation restriction protrusions of the fixing member.

In addition, when the fastening state between the operating member and the moving member is released as the side button is pressed, the moving member may be elastically moved downward by the elastic member while the container body inserted into the moving member falls down out of the container cap.

Advantageous Effects

According to the present invention, the stick-type cosmetic material container having a side button, in which the stick-type cosmetic material container includes a container body provided therein with a stick-type cosmetic material, and a container cap for opening and closing the container body, includes: a side button provided on a side surface of the container cap; a moving member provided inside the container cap to elastically move up and down by an elastic member, and having a fastening part; a fixing member for restricting the moving member from being separated from the container cap; and an operating member fastened to or unfastened from the fastening part of the moving member by moving back and forth by the button, wherein when the operating button is moved to a central portion of the container cap as the side button is pressed, a fastening state between the operating member and the moving member is released, so that the moving member is elastically moved downward while the container body inserted into the moving member falls down out of the container cap so as to be pulled out, thereby improving productivity by a simple structure in which the container body falls out from the container cap, and facilitating use.

In addition, the fastening part having a cylindrical shape protrudes from the upper portion of the moving member which is provided inside the container cap so as to be movable up and down, and the fastening part through-hole through which the fastening part passes is formed at the center of the operating member, wherein the first fastening protrusion wheel is provided at the outer periphery of the fastening part, and the second fastening protrusion wheel is provided in the fastening part through-hole so that the first and second fastening protrusion wheels may be coupled to each other. Accordingly, the moving member and the operating member can be assembled with each other regardless of the coupling direction of the first and second fastening protrusion wheels upon the assembly of the stick-type cosmetic material container, so that the assembly process is simplified, which increases the productivity.

In addition, the moving member is coupled to the fixing member fixedly provided inside the container cap so as to be movable back and forth, and the elastic support part is provided in the fixing member to allow the operating member to be elastically and horizontally moved by the elastic support part, so that the operating member can be operated smoothly without being deformed or damaged even when the operating member is used for a long time.

MODE FOR INVENTION

Best Mode

The present invention and the technical objects achieved by the implementation of the present invention will be more apparent from the following preferred embodiments. Hereinafter, a stick-type cosmetic material container having a side button according to one embodiment of the present invention will be described in detail with reference to the accompanying drawings.

Figure 1:
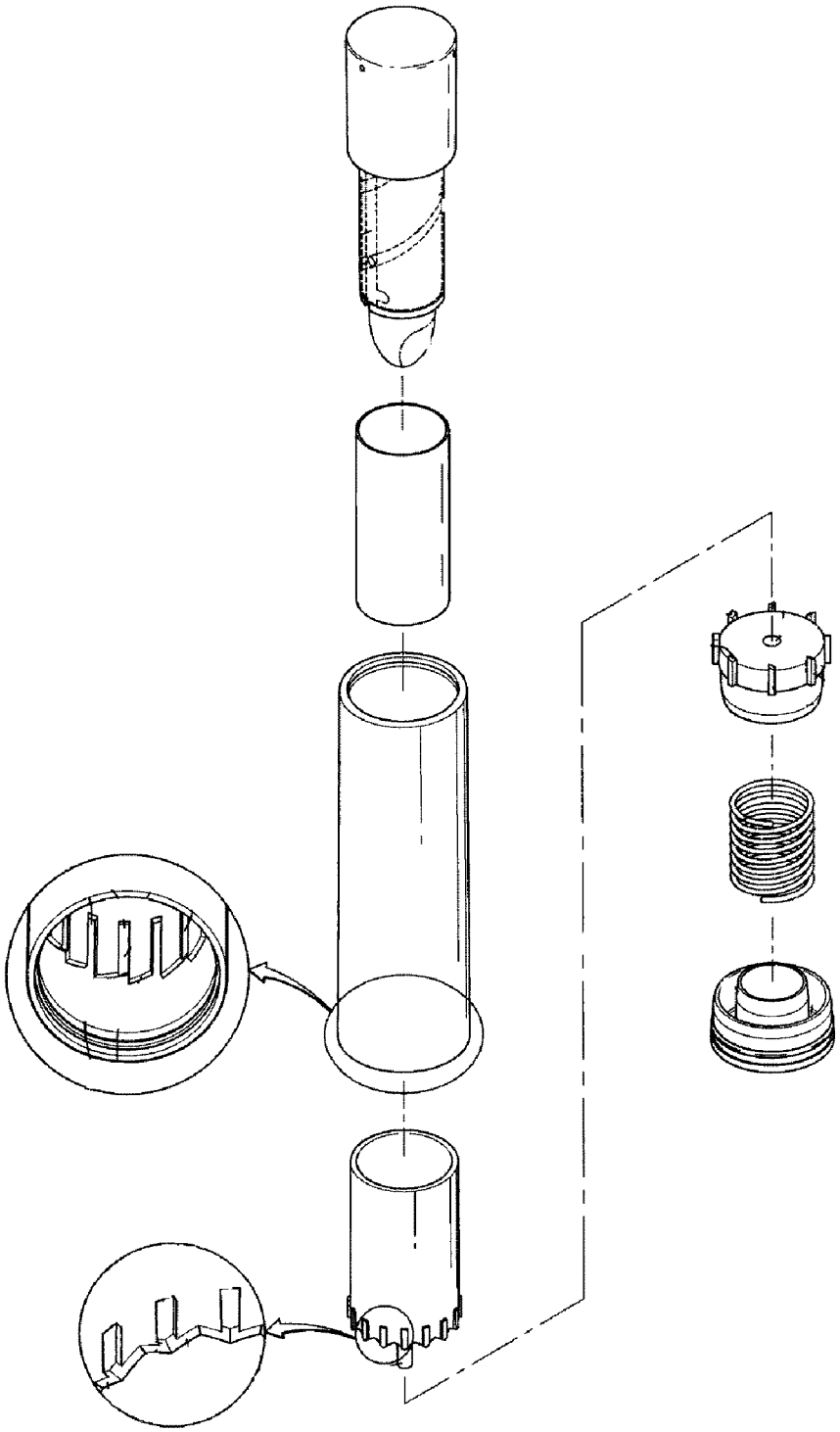
FIG. 1 shows a conventional lipstick container having a separation prevention structure.
Figure 2:
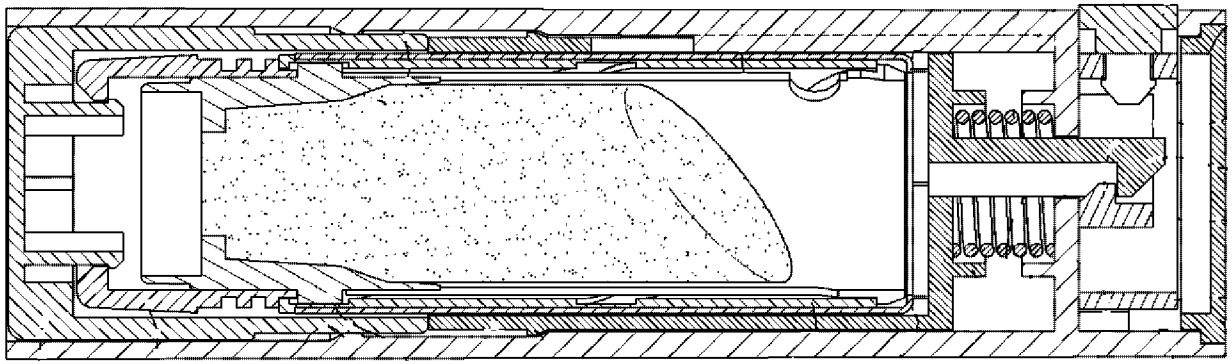
FIG. 2 shows a conventional lipstick container assembly.
Figure 3:
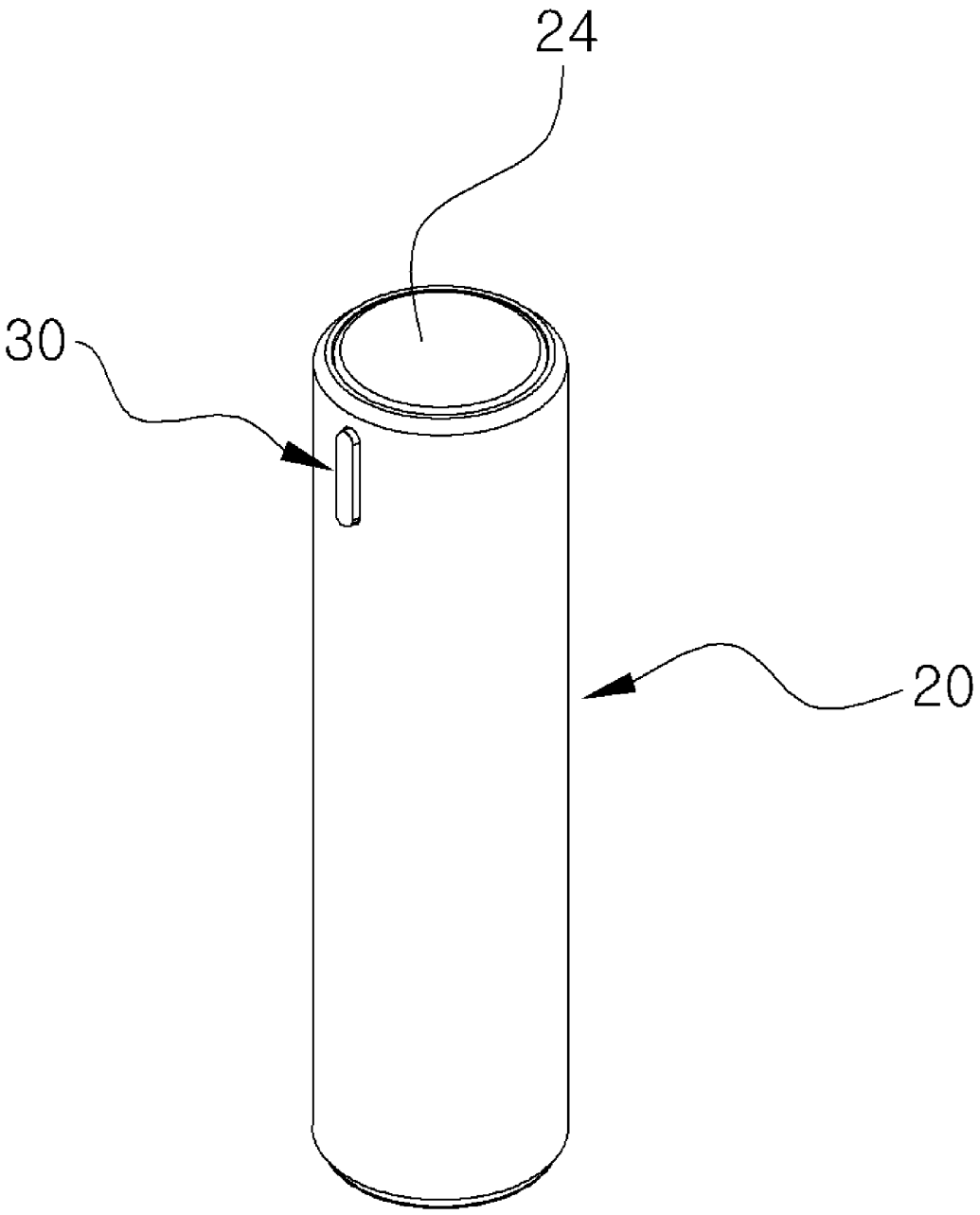
FIG. 3 is a perspective view showing a stick-type cosmetic material container according to the present invention.
Figure 4:
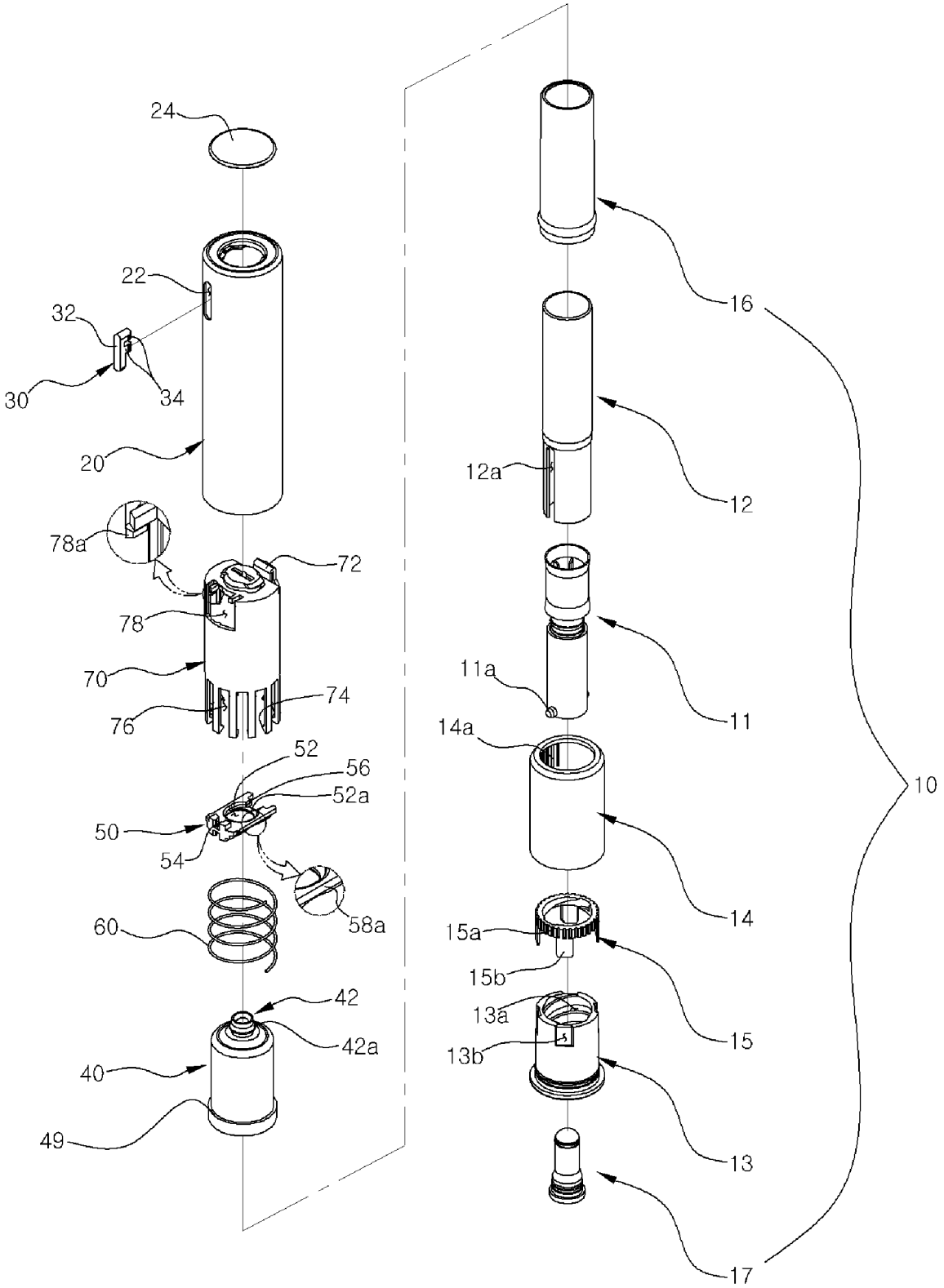
FIG. 4 is an exploded perspective view showing the stick-type cosmetic material container according to the present invention.
Figure 5:
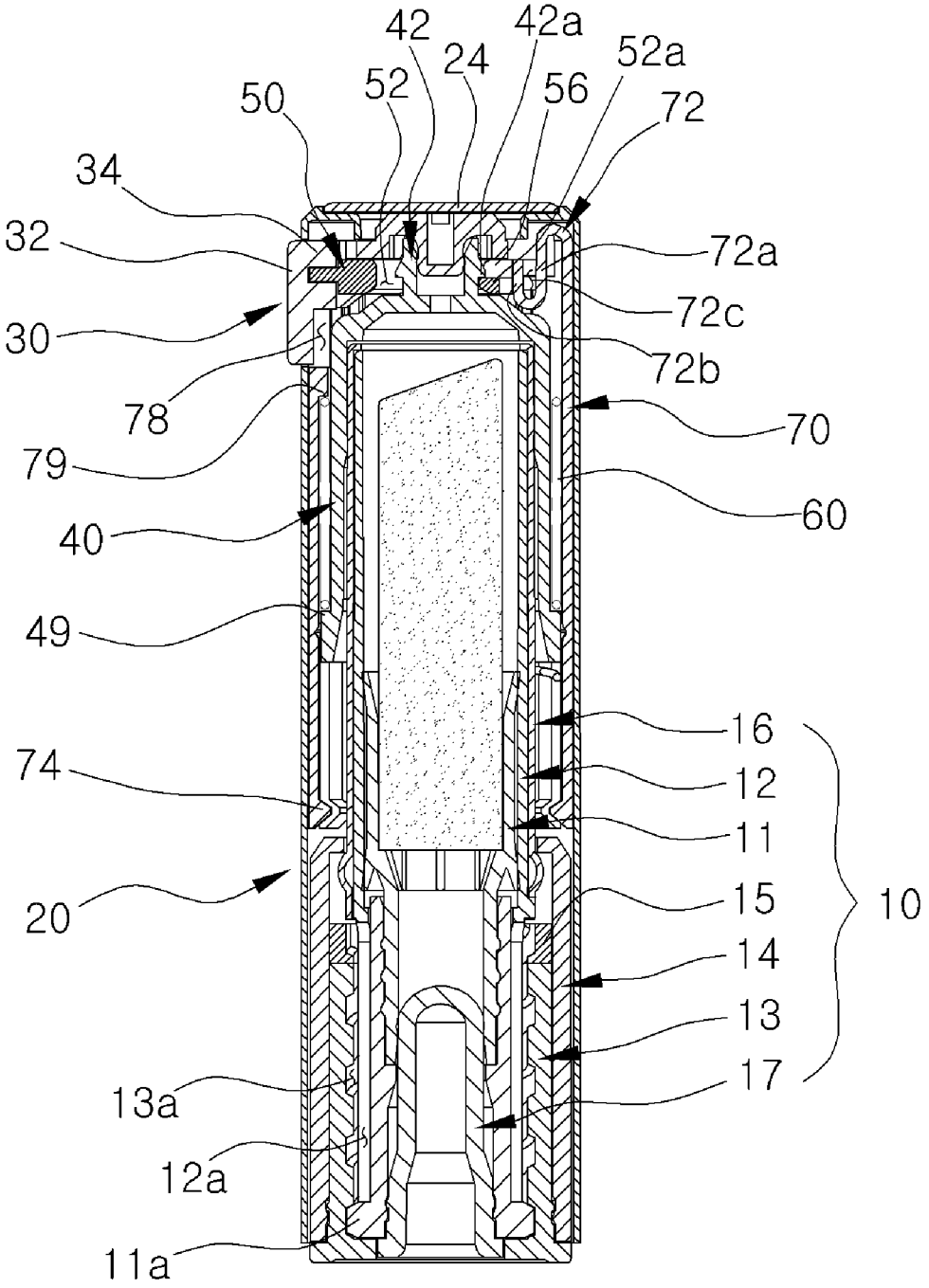
FIG. 5 is a sectional view showing the stick-type cosmetic material container according to the present invention.

FIG. 3 is a perspective view showing a stick-type cosmetic material container according to the present invention, FIG. 4 is an exploded perspective view showing the stick-type cosmetic material container according to the present invention, and FIG. 5 is a sectional view showing the stick-type cosmetic material container according to the present invention.

According to one embodiment of the present invention, a stick-type cosmetic material container having a side button, in which the stick-type cosmetic material container includes a container body 10 provided therein with a stick-type cosmetic material S to withdraw or introduce the stick-type cosmetic material S, and a container cap 20 for opening and closing the container body 10, includes: a side button 30 provided on a side surface of the container cap 20; a moving member 40 provided inside the container cap 20 so as to be movable up and down, in which an upper portion of the container body 10 is inserted into the moving member 40, and having a fastening part 42; an operating member 50 fastened to or unfastened from the fastening part 42 of the moving member 40 by the side button 30; and an elastic member 60 for elastically supporting the moving member 40.

The container body 10 withdraws the stick-type cosmetic material S provided inside the container body 10 to an outside or introduces the stick-type cosmetic material S to an inside of the container body 10 by rotation.

As shown in FIG. 4, the container body 10 includes a cosmetic material dish 11, a guide tube 12, a rotary tube 13, a rotary cap 14, a rotary connection member 15, a protective tube 16, and a closing cap 17.

The cosmetic material dish 11 of the container body 10 is raised and lowered inside the guide tube 12, the stick-type cosmetic material S is attached to an upper portion of the cosmetic material dish 11, and the cosmetic material dish 11 is provided at a lower outer periphery thereof with a lifting/lowering protrusion 11*a*.

The guide tube 12 of the container body 10 is provided on an outer side of the cosmetic material dish 11 to guide a vertical movement of the cosmetic material dish 11, and the guide tube 12 is formed in a lower portion thereof with a vertical movement hole 12*a* through which the lifting/lowering protrusion 11*a* of the cosmetic material dish 11 passes.

The rotary tube 13 of the container body 10 is provided on a lower outer side of the guide tube 12 to rotate and push the cosmetic material dish 11 upward, and the rotary tube 13 is formed at an inner periphery thereof with a rotary thread groove 13*a* into which the lifting/lowering protrusion 11*a* of the cosmetic material dish 11 is inserted, and formed at an outer periphery thereof with a fixing groove 13*b* to which the rotary connection member 15 is fixedly coupled.

The rotary cap 14 of the container body 10 is provided on an outer side of the rotary tube 13, and the rotary cap 14 is provided at an inner periphery thereof which a first fixing tooth 14*a*.

The rotary connection member 15 of the container body 10 is provided on an inner side of the rotary cap 14 and rotated by the rotary cap 14 while rotating the rotary tube 13. The rotary connection member 15 is formed at an outer periphery thereof with a second fixing tooth 15*a* fixedly coupled to the first fixing tooth 14*a* of the rotary cap 14, and the second fixing tooth 15*a* is provided at a lower portion thereof with a fixing part 15*b* inserted into the fixing groove 13*b* of the rotary tube 13.

The protective tube 16 of the container body 10 is coupled between the guide tube 12 and the rotary cap 14 to surround an upper portion of the guide tube 12.

The closing cap 17 of the container body 10 is coupled to a lower center of the rotary tube 13 to seal the rotary tube 13 so that foreign substances are prevented from being introduced through a lower portion of the rotary tube 13.

In other words, as shown in FIG. 5, the lifting/lowering protrusion 11*a* of the cosmetic material dish 11 passes through the vertical movement hole 12*a* of the guide tube 12 while being inserted into the rotary thread groove 13*a* of the rotary tube 13, and the rotary tube 13 is fixedly coupled to the rotary cap 14 by the rotary connection member 15, so that the cosmetic material dish 11 is raised and lowered by rotation of the rotary tube 13. Accordingly, the stick-type cosmetic material S is withdrawn to the outside or introduced into the container body 10.

The container cap 20 opens and closes the container body 10, and is coupled to the container body 10 to surround an entirety of the container body 10 as shown in FIG. 5. Therefore, before use of the stick-type cosmetic material container according to the present invention, the container body 10 is hidden inside the container cap 20, and upon the used of the stick-type cosmetic material container, the container body 10 falls down out of the container cap 20.

As shown in FIG. 4, the container cap 20 is formed at an outer periphery thereof with a button through-hole 22 through which the side button 30 passes, and the closing plate 24 is coupled to an upper end of the container cap 20.

The container cap 20 is provided on a side surface thereof with the side button 30, and provided on an inner side thereof with the moving member 40, the operating member 50, the elastic member 60, and a fixing member 70.

The side button 30 passes through the button through-hole 22 of the container cap 20 to move back and forth when pressed by a user.

The side button 30 has a pressing surface 32 exposed to an outside of the container cap 20, and a coupling protrusion 34 provided at an opposite side of the pressing surface 32 is coupled with the operating member 50.

The moving member 40 is provided inside the container cap 20 so as to be movable up and down.

The moving member 40 has an open bottom, and as shown in FIG. 5, the container body 10 is inserted into the moving member 40 when the container body 10 is coupled to the container cap 20.

The fastening part 42 fastened to or unfastened from the operating member 50 protrudes upward from the moving member 40.

The fastening part 42 has a cylindrical shape, and a first fastening protrusion wheel 42*a* having a ring shape protrudes outward from an outer periphery of the fastening part 42.

The moving member 40 is provided at a lower outer periphery thereof with a first sill 49 on which the elastic member 60 is seated.

The operating member 50 is provided on an upper portion of the moving member 40, and fastened to or unfastened from the fastening part 42 of the moving member 40 by moving back and forth by the side button 30.

The operating member 50 is formed at a center thereof with a fastening part through-hole 52 through which the fastening part 42 of the moving member 40 passes, and as shown in FIG. 5, a second fastening protrusion wheel 52*a* protrudes inward from an outer side of the fastening part through-hole 52 so as to be undercut-coupled with the first fastening protrusion wheel 42*a* of the moving member 40.

As shown in FIG. 4, the second fastening protrusion wheel 52*a* of the operating member 50 may be provided on an outer side of the fastening part through-hole 52 adjacent to an elastic contact part 56 by a predetermined section, and the second fastening protrusion wheel 52*a* of the operating member 50 may be provided on the outer side of the fastening part through-hole 52 in a ring shape.

The operating member 50 is formed on one side thereof with a coupling groove 54 fitted with the coupling protrusion 34 of the side button 30, and provided on an opposite side thereof with the elastic contact part 56 making close contact with an elastic support part 72 of the fixing member 70.

As shown in FIG. 4, the operating member 50 is provided on a side surface thereof with a first horizontal guide protrusion 58*a*.

The fixing member 70 is fixedly provided inside the container cap 20. The fixing member 70 guides a horizontal movement of the operating member 50 while restricting the moving member 40 from being moved by a predetermined section or more.

The fixing member 70 is provided on an upper portion thereof with the elastic support part 72 to elastically and horizontally support the operating member 50, and the elastic support part 72 makes close contact with the elastic contact part 56 of the operating member 50.

As shown in FIG. 5, the elastic support part 72 of the fixing member 70 includes a first elastic piece 72*a* bent in a curved shape from an upper end of the fixing member 70 to extend downward, and a second elastic piece 72*b* bent in a curved shape from the first elastic piece 72*a* to extend upward, and an elastic space 72*c* is formed between the first elastic piece 72*a* and the second elastic piece 72*b*.

In other words, when the side button 30 is pressed by the user, the operating member 50 coupled with the side button 30 is pressed together with the side button 30, so that the elastic contact part 56 of the operating member 50 pushes the second elastic piece 72*b* of the elastic support part 72 rearward, which causes the second elastic piece 72*b* to be bent into the elastic space 72*c*. In addition, when a pressure applied to the side button 30 is released, the second elastic piece 72*b* is restored to an original shape thereof to push the elastic contact part 56 of the operating member 50 forward, so that the side button 30 coupled with the operating member 50 is pushed forward together with the operating member 50.

The fixing member 70 is provided at a lower inner periphery thereof with a separation restriction protrusion 74 to restrict the moving member 40 from being separated from the container cap 20.

As shown in FIG. 4, an elastic slit 76 is formed between separation restriction protrusions 74 of the fixing member 70, and the elastic slit 76 is formed to allow the moving member 40 to be easily inserted into a lower side of the fixing member 70 when the moving member 40 is assembled with the fixing member 70.

The fixing member 70 is formed an upper outer periphery thereof with an operating member insertion hole 78 to which the operating member 50 is coupled.

A second horizontal guide protrusion 78*a* is provided inside the operating member insertion hole 78 of the fixing member 70, and the first horizontal guide protrusion 58*a* of the operating member 50 is seated on a top surface of the second horizontal guide protrusion 78*a*, so that the operating member 50 may horizontally move inside the fixing member 70.

The elastic member 60 vertically and elastically supports the moving member 40. The elastic member 60 has one end making close contact with the first sill 49 of the moving member 40, and an opposite end making close contact with a second sill 79 which is provided on an inner periphery of the fixing member 70.

As described above, in the stick-type cosmetic material container having the side button according to the present invention, the container body 10 falls out from the container cap 20 through an interaction of the above components.

In other words, when the operating member 50 is moved to a central portion of the container cap 20 as the user presses the side button 30, a fastening state between the operating member 50 and the moving member 40 is released, so that the moving member 40 is elastically moved downward by the elastic member 60 while the container body 10 inserted into the moving member 40 falls down out of the container cap 20.

Hereinafter, a method of assembling the stick-type cosmetic material container having the side button, which has a configuration as described above, will be described with reference to the accompanying drawings.

In order to assemble the stick-type cosmetic material container having the side button according to one embodiment of the present invention, first, the container body 10 is assembled as shown in FIGS. 4 and 5.

Referring to an assembly process of the container body 10 in detail, the stick-type cosmetic material S is attached onto an upper portion of the cosmetic material dish 11, and the cosmetic material dish 11 is coupled to an inside of the guide tube 12, such that the lifting/lowering protrusion 11*a* of the cosmetic material dish 11 passes through the vertical movement hole 12*a* of the guide tube 12.

Next, the rotary connection member 15 is fixedly coupled to an upper portion of the rotary tube 13, such that the fixing part 15*b* of the rotary connection member 15 is inserted into the fixing groove 13*b* of the rotary tube 13.

Then, the rotary tube 13 is coupled to a lower side of the guide tube 12, such that the lifting/lowering protrusion 11*a* protruding outward from the vertical movement hole 12*a* of the guide tube 12 is inserted into the rotary thread groove 13*a* of the rotary tube 13.

Thereafter, the protective tube 16 is coupled to an upper side of the guide tube 12, and the rotary cap 14 is coupled to outsides of the rotary tube 13 and the rotary connection member 15, such that the first fixing tooth 14*a* of the rotary cap 14 is fixedly engaged with the second fixing tooth 15*a* of the rotary connection member 15.

Next, the closing cap 17 is coupled to the lower center of the rotary tube 13.

Then, the container cap 20 for opening and closing the container body 10 is assembled.

Referring to an assembly process of the container cap 20 in detail, the operating member 50 is horizontally assembled in the operating member insertion hole 78 of the fixing member 70, such that the first horizontal guide protrusion 58*a* of the operating member 50 is seated on the top surface of the second horizontal guide protrusion 78*a* of the fixing member 70, and the elastic contact part 56 of the operating member 50 makes close contact with the elastic support part 72 of the fixing member 70.

Next, the moving member 40 having an exterior covered with the elastic member 60 is inserted into the lower side of the fixing member 70. At this time, the moving member 40 and the elastic member 60 are inserted while the elastic slit 76 of the fixing member 70 is spread outward.

When the moving member 40 is inserted into an inner end of the fixing member 70, the fastening part 42 of the moving member 40 passes through the fastening part through-hole 52 of the operating member 50, so that the second fastening protrusion wheel 52*a* of the operating member 50 is undercut-coupled with the first fastening protrusion wheel 42*a* of the moving member 40.

Next, after the fixing member 70 assembled as described above is coupled to the inside of the container cap 20, as the side button 30 is provided in the button through-hole 22 of the container cap 20, the coupling protrusion 34 of the side button is fitted into the coupling groove 54 of the operating member 50.

Then, the closing plate 24 is coupled to the upper end of the container cap 20.

Finally, the container body 10 is coupled to the inside of the container cap 20 assembled as described above, so that the assembly of the stick-type cosmetic material container having the side button according to one embodiment of the present invention is completed.

Hereinafter, the use of the stick-type cosmetic material container having the side button, which is assembled as described above, will be described with reference to the accompanying drawings.

Figure 6:
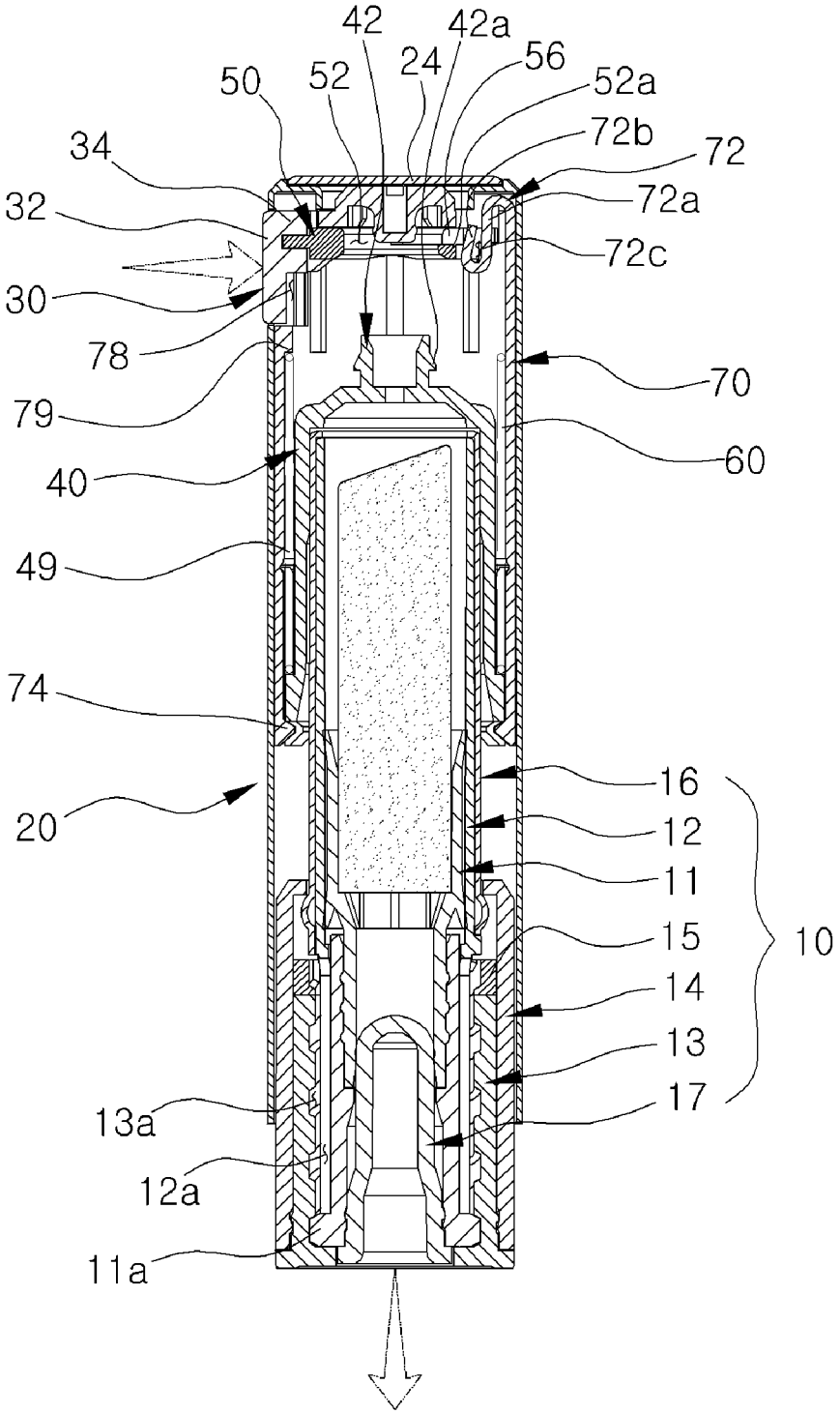
FIG. 6 is a sectional view showing a state in which a side button of the stick-type cosmetic material container according to the present invention is pressed.
Figure 7:
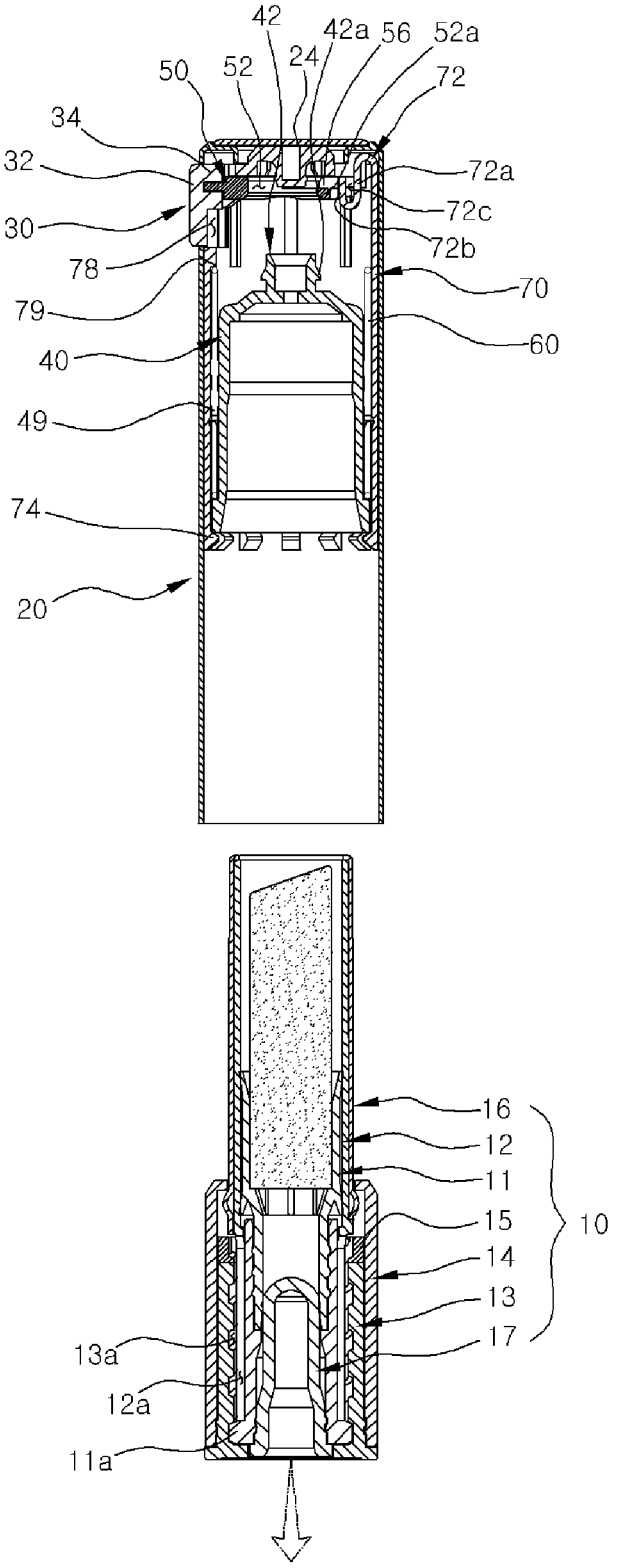
FIG. 7 is a sectional view showing a state in which a container body of the stick-type cosmetic material container according to the present invention is separated from a container cap.
Figure 8:
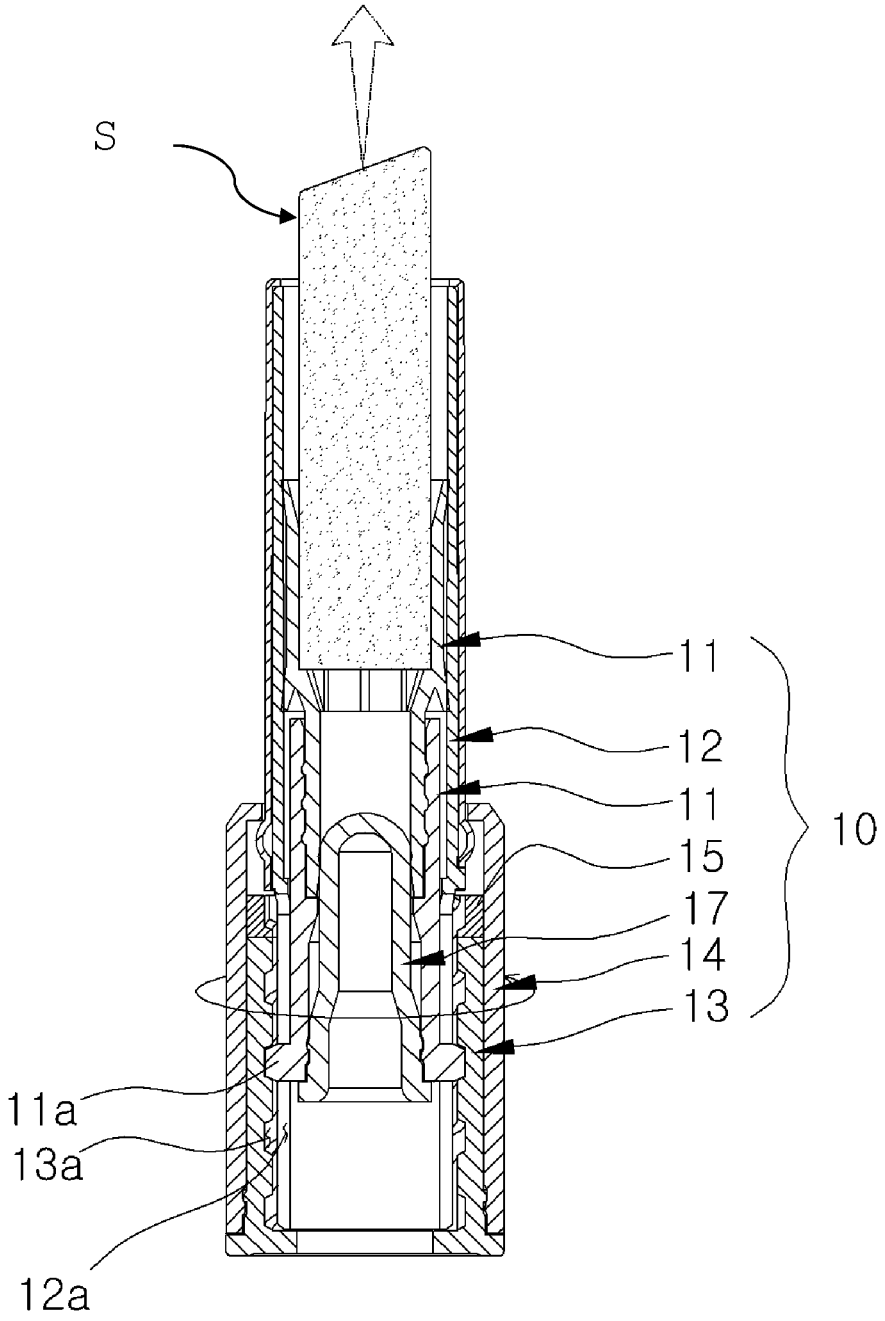
FIG. 8 is a sectional view showing a state in which a stick-type cosmetic material is withdrawn from the container body of the stick-type cosmetic material container according to the present invention.
Figure 9:
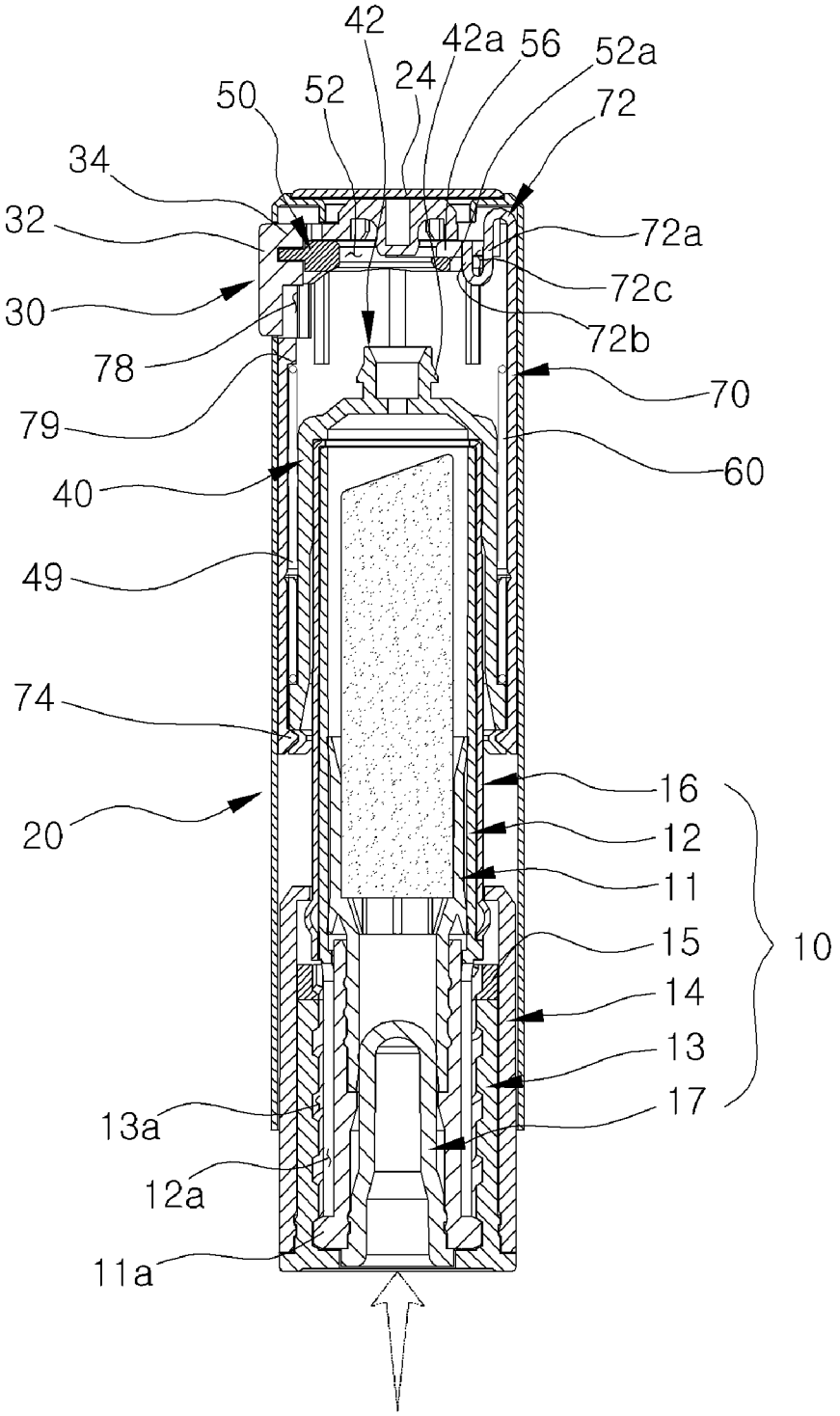
FIG. 9 is a sectional view showing a state in which the container body is coupled to the container cap of the stick-type cosmetic material container according to the present invention.

FIG. 6 is a sectional view showing a state in which a side button of the stick-type cosmetic material container according to the present invention is pressed, FIG. 7 is a sectional view showing a state in which a container body of the stick-type cosmetic material container according to the present invention is separated from a container cap, FIG. 8 is a sectional view showing a state in which a stick-type cosmetic material is withdrawn from the container body of the stick-type cosmetic material container according to the present invention, and FIG. 9 is a sectional view showing a state in which the container body is coupled to the container cap of the stick-type cosmetic material container according to the present invention.

In order to use the stick-type cosmetic material container having the side button according to one embodiment of the present invention, first, as shown in FIG. 6, the side button 30 provided on the outside of the container cap 20 is pressed to allow the container body 10 to fall out from the container cap 20.

When the side button 30 is pressed, the operating member 50 coupled with the side button 30 is pressed together with the side button 30, so that the elastic contact part 56 of the operating member 50 pushes the second elastic piece 72*b* of the elastic support part 72 rearward, which causes the second elastic piece 72*b* to be bent into the elastic space 72*c*. Accordingly, the operating member 50 is moved to the central portion of the container cap 20.

At this time, a fastening state between the second fastening protrusion wheel 52*a* of the operating member 50 and the first fastening protrusion wheel 42*a* of the moving member 40 is released, so that the moving member 40 is elastically moved downward by elasticity of the elastic member 60 while the container body 10 inserted into the moving member 40 falls down out of the container cap 20.

Then, when the pressure applied to the side button 30 is released, the second elastic piece 72*b* is restored to the original shape thereof to push the elastic contact part 56 of the operating member 50 forward, so that the operating member 50 is moved forward. Accordingly, the side button 30 coupled with the operating member 50 returns to an original position thereof.

Thereafter, as shown in FIG. 7, the container body 10 is separated from the container cap 20.

Then, the stick-type cosmetic material S provided inside the container body 10 is withdrawn to perform makeup. As shown in FIG. 8, while holding the protective tube 16 with one hand, when the rotary cap 14 is rotated with the other hand, the rotary connection member 15 and the rotary tube 13 are rotated together with the rotary cap 14, whereas the protective tube 16 and the guide tube 12 are fixed. At this time, the lifting/lowering protrusion 11*a* of the cosmetic material dish 11 is pushed upward by the rotary thread groove 13*a* of the rotary tube 13 and moved upward along the vertical movement hole 12*a* of the fixed guide tube 12, so that the stick-type cosmetic material S attached to the cosmetic material dish 11 may be withdrawn to an upper portion of the protective tube 16.

After the makeup is finished, the rotary cap 14 of the container body 10 is rotated in an opposite direction so that the stick-type cosmetic material S attached to the cosmetic material dish 11 is introduced into the protective tube 16.

Finally, the container body 10 is coupled to the inside of the container cap 20. As shown in FIG. 9, when the container body 10 is pushed into the container cap 20, the upper end of the container body 10 pushes the moving member 40 upward, and when the container body 10 is fully pushed into the container cap 20, the fastening part 42 of the moving member 40 passes through the fastening part through-hole 52 of the operating member 50, so that the second fastening protrusion wheel 52*a* of the operating member 50 is undercut-coupled with the first fastening protrusion wheel 42*a* of the moving member 40, and thus the container cap 20 is fastened to the container body 10.

Accordingly, the use of the stick-type cosmetic material container having the side button according to one embodiment of the present invention is completed.

As described above, although the stick-type cosmetic material container having the side button according to one embodiment of the present invention has been described for illustrative purposes, the present invention is not limited thereto. It is understood that various changes and modifications can be made by those skilled in the art without departing from the spirit and scope of the present invention as disclosed in the appended claims.

[Description of Reference Numerals]

| | |
|---|---|
| 10: Container body | 11: Cosmetic material dish |
| 12: Guide tube | 13: Rotary tube |
| 14: Rotary cap | 15: Rotary connection member |
| 16: Protective tube | 17: Closing cap |
| 20: Container cap | 24: Closing plate |
| 30: Side button | 40: Moving member |
| 42: Fastening part | 50: Operating member |
| 52: Fastening part through-hole | 56: Elastic contact part |
| 60: Elastic member | 70: Fixing member |

-continued

[Description of Reference Numerals]

| | |
|---|---|
| 72: Elastic support part | 74: Separation restriction protrusion |
| S: Stick-type cosmetic material | |

The invention claimed is:

1. A stick-type cosmetic material container having a side button, in which the stick-type cosmetic material container includes a container body provided therein with a stick-type cosmetic material to withdraw or introduce the stick-type cosmetic material, and a container cap for opening and closing the container body, the stick-type cosmetic material container comprising:

the side button provided on a side surface of the container cap;

a moving member movably provided inside the container cap, in which an upper portion of the container body is inserted into the moving member, and having a fastening part having a cylindrical shape;

an operating member moved by the side button and having a fastening part through-hole through which the fastening part passes;

a fixing member fixedly provided inside the container cap; and an elastic member for elastically supporting the moving member, wherein the fixing member is provided with an elastic support part to elastically support the operating member, and the fastening part of the moving member is provided with a first fastening protrusion wheel having a ring shape, and the fastening part through-hole of the operating member is provided with a second fastening protrusion wheel coupled with the first fastening protrusion wheel, so that a fastening state between the operating member and the moving member is released as the fastening part through-hole of the operating button is moved horizontally to a central portion of the container cap when the side button is pressed.

2. The stick-type cosmetic material container of claim 1, wherein the container cap is coupled to the container body to surround an entirety of the container body.

3. The stick-type cosmetic material container of claim 1, wherein the elastic support part of the fixing member includes a first elastic piece bent in a curved shape from an upper end of the fixing member to extend downward, and a second elastic piece bent in a curved shape from the first elastic piece to extend upward, and an elastic space is formed between the first elastic piece and the second elastic piece.

4. The stick-type cosmetic material container of claim 1, wherein the fixing member is provided with a separation restriction protrusion to restrict the moving member from being separated from the container cap.

5. The stick-type cosmetic material container of claim 4, wherein an elastic slit is formed between separation restriction protrusions of the fixing member.

6. The stick-type cosmetic material container of claim 1, wherein when the fastening state between the operating member and the moving member is released as the side button is pressed, the moving member is elastically moved downward by the elastic member while the container body inserted into the moving member falls down out of the container cap.

* * * * *